United States Patent [19]

Schoppee

[11] 3,933,064

[45] Jan. 20, 1976

[54] GUM SLAB FEED APPARATUS

[75] Inventor: Lawrence W. Schoppee, Springfield, Mass.

[73] Assignee: Package Machinery Company, East Longmeadow, Mass.

[22] Filed: Apr. 25, 1974

[21] Appl. No.: 463,909

[52] U.S. Cl. ..... 83/11; 83/12; 83/112; 83/400; 83/417

[51] Int. Cl.[2] ..... B26D 3/08

[58] Field of Search ..... 83/9, 11, 12, 105, 112, 83/155, 155.1, 187, 281, 399, 400, 417, 425.3, 435.1, 437; 192/125 A

[56] References Cited

UNITED STATES PATENTS

| | | | |
|---|---|---|---|
| 2,211,433 | 8/1940 | Papendick | 83/105 |
| 2,311,698 | 2/1943 | Saubestre | 83/12 |
| 2,923,257 | 2/1960 | Monaco | 83/399 X |
| 3,196,917 | 7/1965 | Frank | 83/9 |
| 3,274,956 | 9/1966 | Francia et al. | 83/9 X |
| 3,460,419 | 8/1969 | Branick | 83/187 X |

*Primary Examiner*—J. M. Meister
*Assistant Examiner*—Fred A. Silverberg
*Attorney, Agent, or Firm*—McCormick, Paulding & Huber

[57] ABSTRACT

Slabs of gum stacked in a top-loaded magazine and successively fed from the bottom of the magazine by a reciprocable pusher mechanism are advanced by line pressure along a generally predetermined first path to a rotary trimming and scoring mechanism which trims, scores and further advances each successive slab. Another pusher mechanism receives each slab advanced by the trimming and scoring mechanism and transfers it to a conveyor which carries it along another path generally normal to the first path and to a breaker and an associated wrapping machine. Each mechanism which advances the slab is driven in timed relation with the wrapping machine. The magazine is supported to pivot to an inactive position to facilitate access to the trimming and scoring mechanism.

21 Claims, 4 Drawing Figures

GUM SLAB FEED APPARATUS

BACKGROUND OF THE INVENTION

This invention relates in general to an improved apparatus for feeding slabs of gum to a wrapping machine or the like. The apparatus of the present invention is of the type which may include a magazine and associated mechanism for feeding gum slabs to and along a predetermined first path to a trimming and scoring mechanism wherein the ends of each slab are trimmed and a plurality of parallel score lines are formed thereon which extend in the direction of the first path to divide the slab into a plurality of sticks connected in side-by-side relation along the score line. Apparatus of the aforedescribed general type also includes an in-feed conveyor which receives the trimmed and scored slab and carries it along a second path generally normal to the first path and toward a breaker and wrapping machine where the slab is broken or separated into individual sticks which are wrapped. A problem has been encountered in transferring the trimmed and scored slab from the trimming and scoring mechanism to the in-feed conveyor. In the past, transfer rolls have been employed to advance the slab to the in-feed conveyor. If the transfer rolls operate in timed relation with the wrapping machine, no serious problem is encountered at the full wrapping speed, since the transfer rolls turn at sufficient speed to eject the slab clear of the rolls and onto the in-feed conveyor. However, when the wrapper is operated at jog speed or manually, as by a handwheel, the transfer rolls may not, and generally do not, attain sufficient speed to properly eject the slab, with the result that a jam or pile up of slabs may occur between the transfer rolls and the in-feed conveyor. This problem has been overcome, to some degree, by providing a separate or independent drive motor for the transfer rolls, so that the latter rolls operate at a constant speed at all times. However, the rate at which the in-feed conveyor travels will vary with the operational speed of the wrapping machine, as for example, when the wrapping machine is stopped or started. Under such conditions properly timed relationship between the independently driven transfer rolls and the in-feed conveyor cannot be maintained.

If a magazine apparatus is employed to feed slabs to the trimming and scoring mechanism, it is generally desirable that the distance between the magazine and the trimming and scoring mechanism be kept as short as possible to minimize feed problems in transferring slabs from the magazine to the latter mechanism. However, because of the closely spaced relationship between the magazine and the trimming and scoring mechanism, it becomes difficult to remove damaged slabs which may become lodged therebetween in the event of malfunction. The present invention is concerned with improvements in slab feed apparatus aimed at overcoming the aforedescribed general problems.

SUMMARY OF THE INVENTION

In accordance with the present invention, an improved gum slab feeding apparatus is provided which includes a mechanism, which may comprise a magazine for containing a supply of gum slabs and an associated pusher mechanism, for feeding successive slabs to and along a first path to a trimming and scoring mechanism which trims each slab, scores it and further advances it along the first path. Another pusher mechanism receives the trimmed and scored slab and further advances it to an in-feed conveyor which carries the slab toward a breaker and a wrapping machine. The latter pusher mechanism and various mechanisms for advancing the slab are driven in timed relation with the wrapping machine. When a magazine is utilized, it is supported to pivot to an inactive position to permit access to the area between the magazine and the trimming and scoring mechanism.

DETAILED DESCRIPTION OF THE PREFERRED EMBODIMENT

Figure 1:
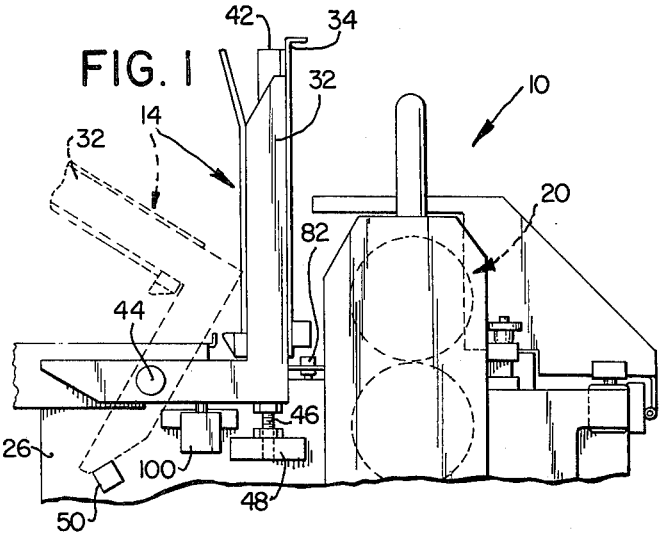
FIG. 1 is a fragmentary side elevational view of magazine feed apparatus embodying the present invention.

In the drawings, a magazine feed apparatus embodying the present invention is indicated generally by the reference numeral 10. The apparatus 10 is particularly adapted to feed a substantially continuous supply of gum to a wrapping machine 12 (FIG. 2) and comprises a top-loaded magazine, indicated generally at 14, which contains a plurality of gum slabs S, S arranged in vertical stacked relation, an associated pusher mechanism, designated generally by the numeral 16, which successively feeds slabs S, S from the magazine 14 to and along a generally horizontal path 18 to a trimming and scoring mechanism 20, a transfer mechanism 22 which further advances the trimmed and scored slabs, and a conveyor 24 which carries the slabs S, S to the wrapping machine 12. The magazine 14 is disposed in close proximity to the trimming and scoring mechanism 20 and is arranged to pivot from its active or full line position in FIG. 1 to an inactive position, designated by broken lines, wherein it is horizontally displaced a substantial distance from the trimming and scoring mechanism 20 to permit convenient access thereto.

Considering now the apparatus 10 in further detail, it has a frame 26 which supports a horizontally disposed surface plate 30 to partially define a horizontal path 18. The magazine 14 is pivotally supported on the frame 26 and has a pair of generally L-shaped end brackets 32, 32, each of which includes a horizontal leg and a vertical leg. The front wall of the magazine is defined by a vertically disposed front plate 34 which is connected to the vertical legs of the end brackets 32, 32 and extends transversely therebetween. The lower edge of the plate 34, designated at 36 and best shown in FIG. 3, extends transversely of the path 18 in vertically spaced relation thereto when the magazine is in its active position. The end brackets 32, 32 are further connected by a cross member 38 which extends transversely therebetween and carries a pair of transversely spaced upright members 40, 40 which project upwardly therefrom to define the open rear portion of the magazine 14.

Figure 2:
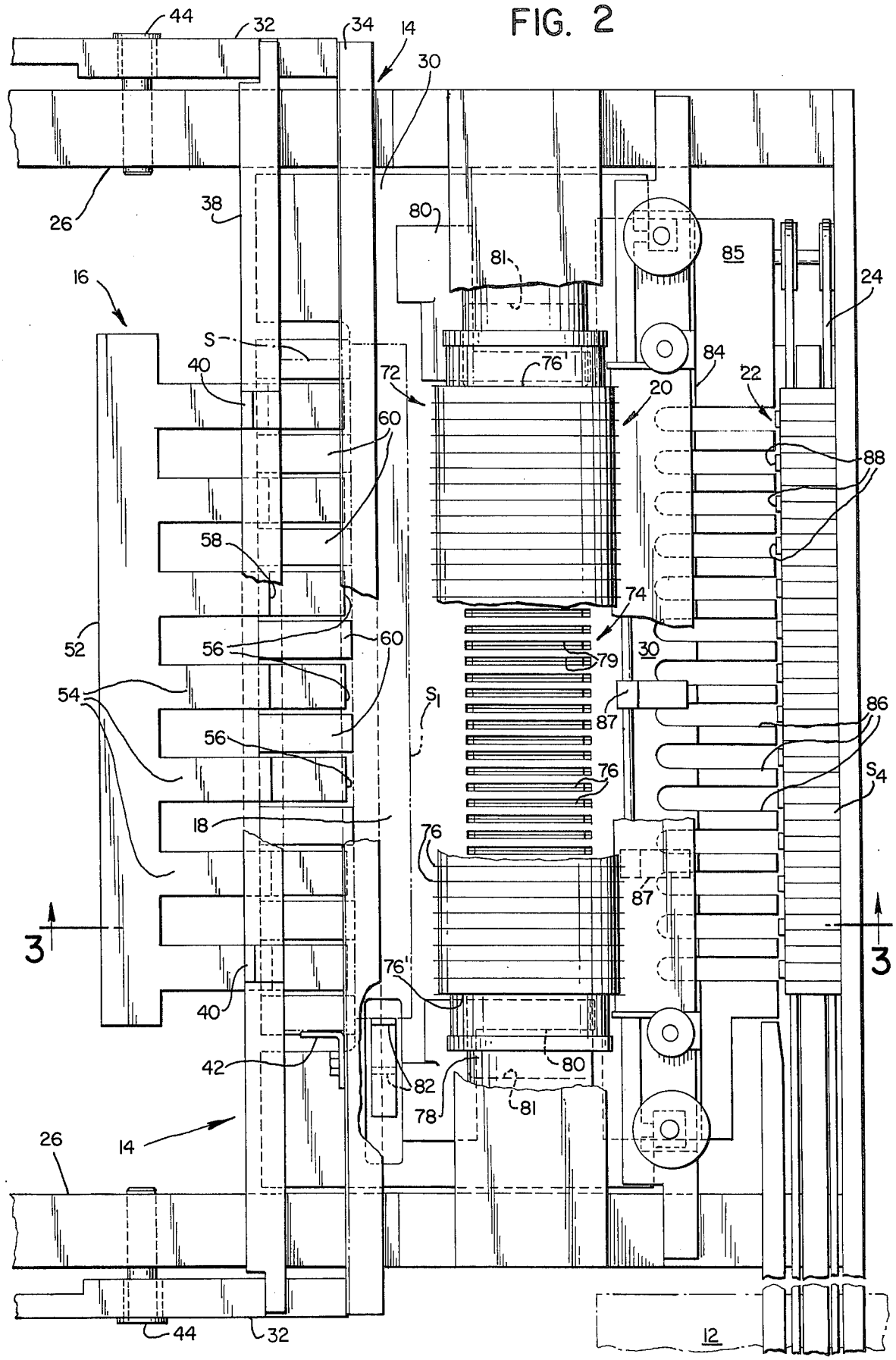
FIG. 2 is a somewhat enlarged fragmentary plan view of the apparatus of FIG. 1.

The magazine further includes one end wall defined by a vertically extending angle bracket 42 fastened to the front plate 34 and best shown in FIG. 2. Each end bracket 32 is pivotally connected to an associated side of the frame 26 by a pivot pin 44 which is mounted on the side member and extends through the horizontal leg of the bracket. The forward end of each bracket 32 rests on the head of a vertically adjustable screw 46 threaded into a nut 48 mounted in fixed position on the frame 26, as best shown in FIG. 1. Stops 50, 50 mounted at opposite sides of the frame cooperate with the end brackets 32, 32 when the magazine is pivoted in its inactive position to support it in a latter position.

The pusher mechanism 16 associated with the magazine includes a transversely extending pusher 52 arranged for sliding movement on the upper surface of the plate 30. The pusher 52 has a plurality of integral transversely spaced and forwardly projecting pusher fingers 54, 54 as best shown in FIG. 2. Each pusher finger has a forwardly facing abutment surface 56 at its forward end. The forward end portion of each finger 54 is disposed at a slightly lower elevation than the rear portion thereof and is separated from the rear portion by another forwardly facing abutment surface 58. The difference in elevation between the forward and rear end portions of each finger is substantially equal to the thickness of a single slab S, as will be evident from FIG. 3. The fingers 54, 54 are received between a series of transversely spaced guide plates 60, 60, mounted on the upper surface of the plate 30 and located immediately below the magazine 14 when it is in its active position. The upper surface of each guide plate 60 is disposed at a slightly higher elevation than the upper surface of the forward end portion of each pusher finger 54, that is, the portion of each finger forward of its abutment surface 58.

Reciprocal forward and rearward movement is imparted to the pusher 52 by a drive mechanism which includes a bell crank 62 and a link 64 connected between one end of the bell crank 62 and the pusher 52. The other end of the bell crank is connected to a main drive or crank shaft 66 by a connecting rod 68.

The trimming and scoring mechanism 20 is located forward of the magazine 14 in relatively closely spaced relation thereto. It includes upper and lower sets of scoring knives respectively indicated at 72 and 74. Considering the upper knife set 72, and referring particularly to FIG. 2, it comprises a transversely spaced series of rotary scoring knives or discs 76, 76 coaxially mounted on a shaft 78 journalled for rotation about an axis which extends transversely of the path 18. The lower knife set 74 is substantially identical to the upper knife set 72, however, segments of the peripheral edges of the lower scoring knives project upwardly through slots 79, 79 in the surface plate 30 to cooperate, above the upper surface of the latter plate, with respectively associated scoring knives in the upper set.

Each of the outboard scoring knives, designated 76', 76' in FIG. 2, has a deflector 80 mounted generally adjacent thereto. An opening 81 is formed in the plate 30 immediately below each deflector 80. The upper and lower knife sets 72 and 74 are driven in timed relation to the pusher mechanism 16 and are or may be driven by the main drive shaft 66.

A transverse alignment pusher 82, shown in FIG. 2 and located between the magazine 14 and the trimming and scoring mechanism 20, projects upwardly through a slot in the surface plate 30 forward of the magazine front plate 34 and the end wall 42. The alignment pusher is arranged for reciprocal transverse movement from a position outward of the end wall 42 to another position inward thereof. The latter positions of the alignment pusher are respectively shown in full and broken lines in FIG. 2. A drive mechanism, not shown, operates the alignment pusher 82 in timed relation to the operation of the pusher mechanism 16. A plurality of transversely spaced apart holddown fingers 83, 83 (one shown in FIG. 3) are also located between the magazine 14 and the trimming and scoring mechanism 20.

Figure 3:
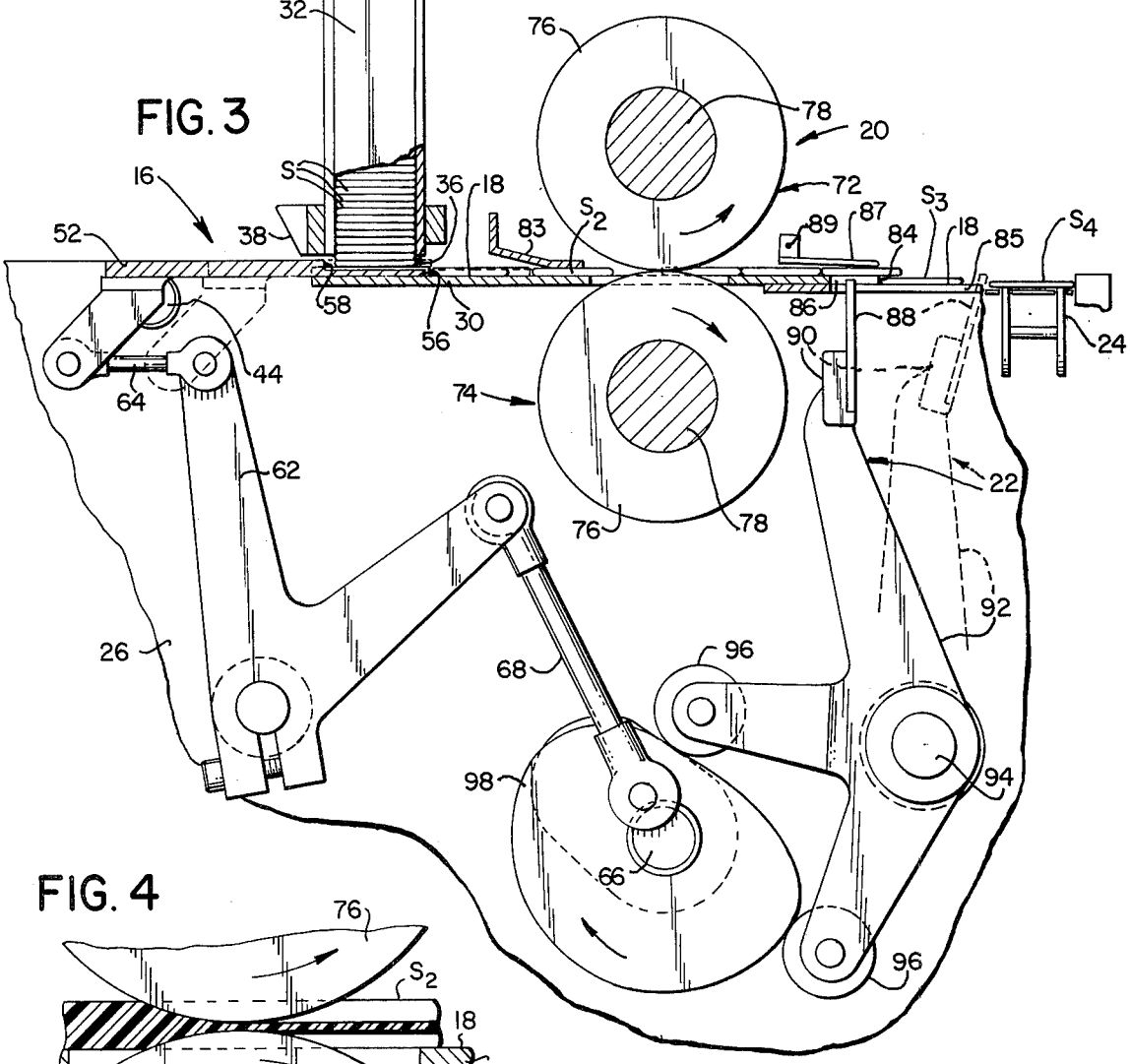
FIG. 3 is a sectional view taken along the line 3—3 of FIG. 2.
Figure 4:
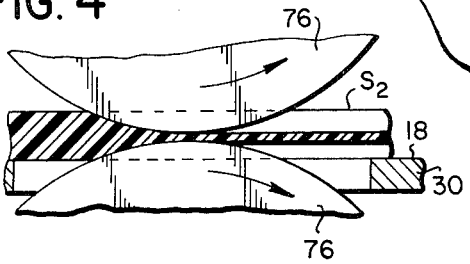
FIG. 4 is a somewhat enlarged fragmentary side elevational view of the apparatus as shown in FIG. 3, a gum slab being shown in section.

The surface plate 30 terminates at a forward edge 84 forward of the trimming and scoring mechanism 20. Another surface plate 85 disposed adjacent the lower surface of the plate 30 extends forwardly beyond the edge 84 and terminates generally adjacent the in-feed conveyor 24. The upper surface of the plate 85 is horizontally aligned with the upper surface of the in-feed conveyor 24 and defines another portion of the path 18. A transverse series of forwardly extending slots 86, 86 formed in the forward portion of the plate 30 and in the plate 85 open toward the in-feed conveyor 24. A plurality of pivoted holddown fingers 87, 87 arranged in transversely spaced series along an axis 89 which extends transversely of the frame 26 are disposed above the forward end of the plate 30, substantially as shown in FIG. 3.

The transfer mechanism 22 includes a plurality of pusher fingers 88, 88 equal in number to the slots 86, 86. The pusher fingers are mounted along a transversely extending pusher bar 90, each finger 88 being disposed in an associated slot 86. The bar 90 is carried by a lever assembly 92 pivoted on a rock shaft 94 which extends transversely of the frame 26, as shown in FIG. 3. Roller followers 96, 96 carried by the lever 94 engage a conjugate cam 98 keyed to the shaft 66. Rotation of the shaft 66 causes reciprocal movement of the transfer or pusher mechanism 22. The latter mechanism is arranged to move in timed relation with the other mechanisms which advance the gum slabs and which comprise the feed apparatus 10.

Slabs of gum S, S are loaded in the top of the magazine 14. The open rear wall of the magazine facilitates loading so that the slabs S, S may be conveniently stacked in end engagement with the end wall 42. At the beginning of a cycle, when the pusher 52 is in its retracted or full line position of FIG. 3, the guide plates 60, 60 cooperate to define the bottom of the magazine. As the pusher 52 advances toward its broken line position, FIG. 3, the abutment surfaces 58, 58 engage the rear edge of the lowermost slab S' in the magazine, which is then resting on the guide plates 60, 60, and push it in a forward direction past the lower edge 36 and out of the magazine. The vertical position of the lower edge 36 is adjusted to prevent more than one slab from being fed from the magazine during each pusher cycle. When the pusher reaches its advanced or broken line position, FIG. 3, the slab rests on the forward end portions of the fingers beyond the forward edges of the guide plates 60, 60 and the rear portions of the pusher fingers 54, 54 now define the bottom of the magazine.

During the return stroke of the pusher 52, the forward edges of the guide plates 60, 60 engage the rear edge of the slab to prevent retrograde slab movement. The cross member or bar 38 prevents the lowermost slab in the magazine, now resting on the pusher fingers 54, 54 from being moved rearward out of the magazine during the return stroke of the pusher 52. When the pusher 52 attains its retracted position, the slab is disposed in the path 18 in general transverse alignment with the alignment pusher 82 which then moves inwardly to its full line position to move the slab to position $S_1$, FIG. 2, and align it with the trimming and scoring mechanism.

During the next cycle of the pusher, the abutment surfaces 58, 58 engage the next successive slab S at the bottom of the stack, whereas the abutment surfaces 56, 56 engage the slab at position $S_1$ and advance it to position $S_2$. The next successive cycle of the pusher mechanism 16 causes the slab at position $S_2$ to advance under line pressure exerted by the slab therebehind. The advancing slab is held down against the surface of the plate 30 and in the path 18 by the holddown fingers 83, 83 and enters the nip between the upper and lower knife sets 72 and 74. The slab is then further advanced by the latter knife sets while it is simultaneously scored.

The scoring knives which comprise the scoring mechanism 20 cut only partially through the upper and lower surfaces of the slab to form parallel score lines thereon. As the slab passes through the trimming and scoring mechanism 20, the deflectors 80, 80 engage selvage at the opposite marginal end portions thereof and deflect it downwardly to break it away from the slab and cause it to drop through the openings 81, 81. In the manner aforedescribed, the slab is trimmed to desired length.

Each slab is further advanced by line pressure exerted by the next succeeding slab advanced by the trimming and scoring mechanism. The pivoted holddown fingers 87, 87 stabilize the slab as it passes thereunder. The slab continues to advance under line pressure until it passes the forward edge 84 whereupon it drops to the lower level of the path 18, as defined by the upper surface of the plate 85, a slab in the latter position being indicated at $S_3$, FIG. 3. At this point in time, the pusher mechanism 22 is in its retracted position, the pusher fingers 88, 88 being disposed within the slots 86, 86 and rearwardly of the forward edge 84. The pusher mechanism 22 dwells in the latter position while the slab advances to position $S_3$ whereupon the pusher fingers 88, 88 move to the forward position in full lines in FIG. 2 and indicated by broken lines in FIG. 3, to advance the slab to position $S_4$ on the in-feed conveyor 24 which carries the slab in a transverse direction to a breaker (not shown). The breaker, which includes conventional breaker wheels, separates the slab into individual sticks by breaking it along the various score lines. The sticks are then wrapped by the wrapping machine 12. The pusher mechanism 22, of course, operates in timed relation with the in-feed conveyor 24 so that each slab is advanced a sufficient distance by the conveyor 24 before the next successive slab is fed to the conveyor by the pusher mechanism 22. The entire feed mechanism which comprises the apparatus 10 is driven in timed relation with the wrapping machine 12.

In setting up the apparatus 10, it may be desirable to jog it or cycle it manually, as for example, by turning a hand wheel (not shown) associated with main drive shaft 66. In the present apparatus, this may be done without the risk of jam occurrence in the path of slab advance, since each portion of the apparatus which advances the slab operates in timed relation with the other portions thereof under all conditions of operation.

Occasionally, it may be necessary to gain access to the trimming and scoring mechanism 20 to clear a jam or correct a malfunction and it is for this reason that the magazine is arranged for pivotal movement to its inactive position. To assure the safety of the operator when the magazine is in its inactive position, a microswitch 100 is provided which is activated by the magazine 14 in its active position. The microswitch 100 is electrically interlocked with the drive motor or motors which operate the apparatus 10 and the wrapping machine 12. The switch 100 functions to disable the drive for the apparatus 10 and the wrapping maching when the magazine is pivoted to its inactive position. The micro-switch 100 is preferably connected in circuit with a reset button or the like (not shown), remote from the scoring and trimming mechanism, which must be actuated to restore power to the various motor drives. However, power cannot be restored to the drive unit by operating the reset button unless the magazine is first lowered to its active position to engage and activate the micro-switch 100. An electrically interlocked guard enclosure is also provided to cover the trimming and scoring mechanism 20, as shown in FIG. 1, for the further protection of the operator.

I claim:

1. Apparatus for feeding gum to a wrapping machine or the like and comprising means defining a substantially horizontal path of gum travel, a magazine feed mechanism for feeding a succession of slabs of gum to and along said path and including a magazine for containing a supply of gum slabs, means supporting said magazine for movement between an active position wherein it extends upwardly from said path to maintain the supply of slabs in vertically stacked relation and an inactive position wherein it is displaced a substantial distance from said active position, and means for successively feeding slabs from the bottom of said magazine to said path and advancing the slabs along said path, and a scoring mechanism mounted in said path for receiving each successive slab advanced by said feeding means and scoring it along a plurality of generally parallel score lines as it advances along said path.

2. Apparatus for feeding gum as set forth in claim 1 wherein said supporting means comprises means for supporting said magazine for pivotal movement about an axis extending transversely of said path.

3. Apparatus for feeding gum as set forth in claim 2 wherein said axis is horizontally spaced from said magazine.

4. Apparatus for feeding gum as set forth in claim 3 wherein said apparatus has a frame and said supporting means comprises a pair of generally L-shaped end brackets pivotally connected to said frame and respectively supporting opposite ends of said magazine.

5. Apparatus for feeding gum as set forth in claim 2 wherein said magazine in its active position is disposed in close relation to said scoring mechanism and said magazine in its inactive position is displaced a substantial horizontal distance from said scoring mechanism and a substantial vertical distance above said path.

6. Apparatus for feeding gum as set forth in claim 1 including means for driving said scoring mechanism in timed relation to said feeding means and means for disabling said drive means when said magazine is moved from its active position toward its inactive position and while said magazine is in its inactive position.

7. Apparatus for feeding gum as set forth in claim 6 wherein said disabling means comprises an electrical switch electrically connected to said drive means and actuated by said magazine in its active position.

8. Apparatus for feeding gum as set forth in claim 1 including adjustable support means for holding said magazine in its active position and for adjusting the active position of said magazine relative to said path.

9. Apparatus for feeding gum as set forth in claim 8 wherein said apparatus has a frame, said magazine supporting means is mounted on said frame, and said adjustable support means comprises a nut mounted in fixed position on said frame and an adjustment screw threadably engaging said nut.

10. Apparatus for feeding gum as set forth in claim 1 wherein said scoring means comprises means for further advancing each successive slab along said path.

11. Apparatus for feeding gum as set forth in claim 10 wherein said scoring means comprises a plurality of rotary scoring knives mounted in axially spaced series along a shaft and journalled for rotation about an axis extending transversely of said path.

12. Apparatus for feeding gum as set forth in claim 10 including means for trimming the opposite marginal portions of each successive slab as it advances along said path.

13. Apparatus for feeding gum as set forth in claim 12 wherein said scoring means comprises said trimming means.

14. Apparatus for feeding gum as set forth in claim 10 wherein said scoring mechanism comprises upper and lower sets of rotary scoring knives for respectively engaging and cutting through the upper and lower surfaces of each successive slab as it advances along said path to define score lines therein extending across the slab and in the direction of said path.

15. Apparatus for feeding gum as set forth in claim 10 wherein said apparatus includes transfer means for receiving each successive slab advanced by said scoring means and further advancing it along said path and to an in-feed conveyor which carries the slab toward the wrapping machine.

16. Apparatus for feeding gum as set forth in claim 15 wherein said apparatus includes means for driving said feeding means, said scoring mechanism and said transfer means in timed relation to the in-feed conveyor and the wrapping machine.

17. Apparatus for feeding gum as set forth in claim 15 wherein said path includes a first portion and a second portion at a lower elevation than said first portion, said magazine mechanism and said scoring mechanism are associated with said first portion and said transfer means is associated with said second portion.

18. Apparatus for feeding gum as set forth in claim 17 wherein said transfer means comprises a pusher mechanism.

19. Apparatus for feeding gum as set forth in claim 18 including holddown means for engaging each successive slab to maintain it generally in said path as it advances from said first to said second portion of said path.

20. Apparatus for feeding gum as set forth in claim 19 wherein said holddown means comprises a transversely spaced series of holddown fingers supported above said path to pivot about an axis extending transversely of said path.

21. Apparatus for feeding gum as set forth in claim 1 wherein said feeding mechanism comprises a pusher mechanism.

* * * * *